US007025495B2

(12) United States Patent
Colarieti

(10) Patent No.: US 7,025,495 B2
(45) Date of Patent: Apr. 11, 2006

(54) SUPPORT AND WINDING-UP DEVICE FOR AUTOMATIC WRIST WATCHES

(76) Inventor: Sandro Colarieti, Rue Du Mole, 4, CH-2001 Neuchatel (CH)

( * ) Notice: Subject to any disclaimer, the term of this patent is extended or adjusted under 35 U.S.C. 154(b) by 0 days.

(21) Appl. No.: 10/864,055

(22) Filed: Jun. 8, 2004

(65) Prior Publication Data

US 2005/0169111 A1 Aug. 4, 2005

(51) Int. Cl.
*G04B 3/00* (2006.01)
*G04C 1/04* (2006.01)

(52) U.S. Cl. ..... 368/206; 81/7.5

(58) Field of Classification Search ..... 368/10, 368/206, 207; 81/7.5
See application file for complete search history.

(56) References Cited

U.S. PATENT DOCUMENTS 2,863,345 A * 12/1958 Fiechter ..... 81/7.5
2,917,955 A * 12/1959 Leger ..... 81/7.5
4,057,958 A * 11/1977 Wuntch ..... 368/207
5,608,693 A * 3/1997 Richards ..... 368/10
5,988,871 A * 11/1999 Bonnet ..... 368/206

* cited by examiner

*Primary Examiner*—Kamand Cuneo
*Assistant Examiner*—Jeanne-Marguerite Goodwin
(74) *Attorney, Agent, or Firm*—Hedman & Costigan

(57) ABSTRACT

A device for supporting and winding-up automatic wrist watches comprises a base including a plurality of rotary supporting elements, each provided with latching means for housing a wrist watch therein, the supporting elements being rotatively driven by a geared-motor unit.

3 Claims, 4 Drawing Sheets

SUPPORT AND WINDING-UP DEVICE FOR AUTOMATIC WRIST WATCHES

BACKGROUND OF THE INVENTION

The present invention relates to a support and winding-up device for supporting and winding-up automatic wrist watches.

As is known, automatic wrist watches conventionally comprise a winding-up mechanism driven by the watch mechanism or movement, as the watch is born on an user wrist.

If, with the watch in a non-use condition, the watch movement is not actuated, the watch, after a time, will stop.

This is undesirable, since, as an user desires to use his/her watch again, he/she must necessarily re-wind the watch and adjust the hour, minutes, date and other data, some wrist watches are provided with.

Moreover, it is undesirable to leave the watch movement unactuated for a comparatively long time, since it would be susceptible to damages.

This is a very important problem for users having a lot of wrist watches, which, as it should be apparent, cannot be simultaneously used.

SUMMARY OF THE INVENTION

Accordingly, the aim of the present invention is to provide such a wrist watch supporting and winding-up device, which is designed to always hold in operation automatic wrist watches.

Within the scope of the above mentioned aim, a main object of the invention is to provide such a device which also allows an exhibition to the view of the wrist watches.

Another object of the present invention is to provide such a device, of very simple and strong construction, which is very reliable and safe in operation.

Yet another object of the present invention is to provide such a device which is aesthetically pleasant and can clearly exhibit the aesthetic advantages of the wrist watches supported thereby.

According to one aspect of the present invention, the above mentioned aim and objects, as well as yet other objects, which will become more apparent hereinafter, are achieved by an improved device for supporting, winding-up and preserving automatic wrist watches, characterized in that said device comprises a base supporting a plurality of rotary supporting elements, each said supporting element including latching means for supporting a respective wrist watch, and a gear-motor unit for rotatably driven said supporting elements.

BRIEF DESCRIPTION OF THE DRAWINGS

Further characteristics and advantages of the present invention will become more apparent hereinafter from the following detailed disclosure of a preferred, though not exclusive, embodiment of the invention which is illustrated, by way of an indicative but not limitative example, in the accompanying drawings, where.

DESCRIPTION OF THE PREFERRED EMBODIMENT

Figure 1:
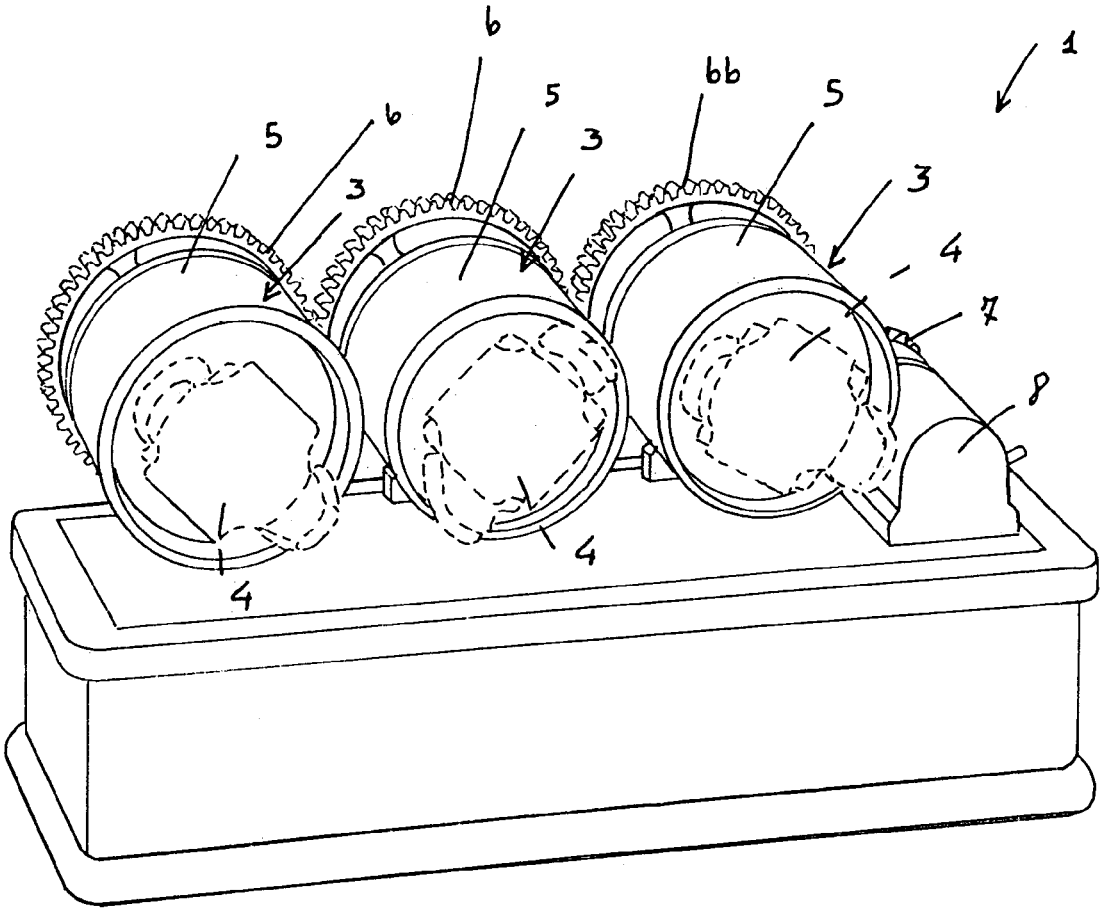
FIG. 1 is a perspective view of a device according to the present invention.
Figure 2:
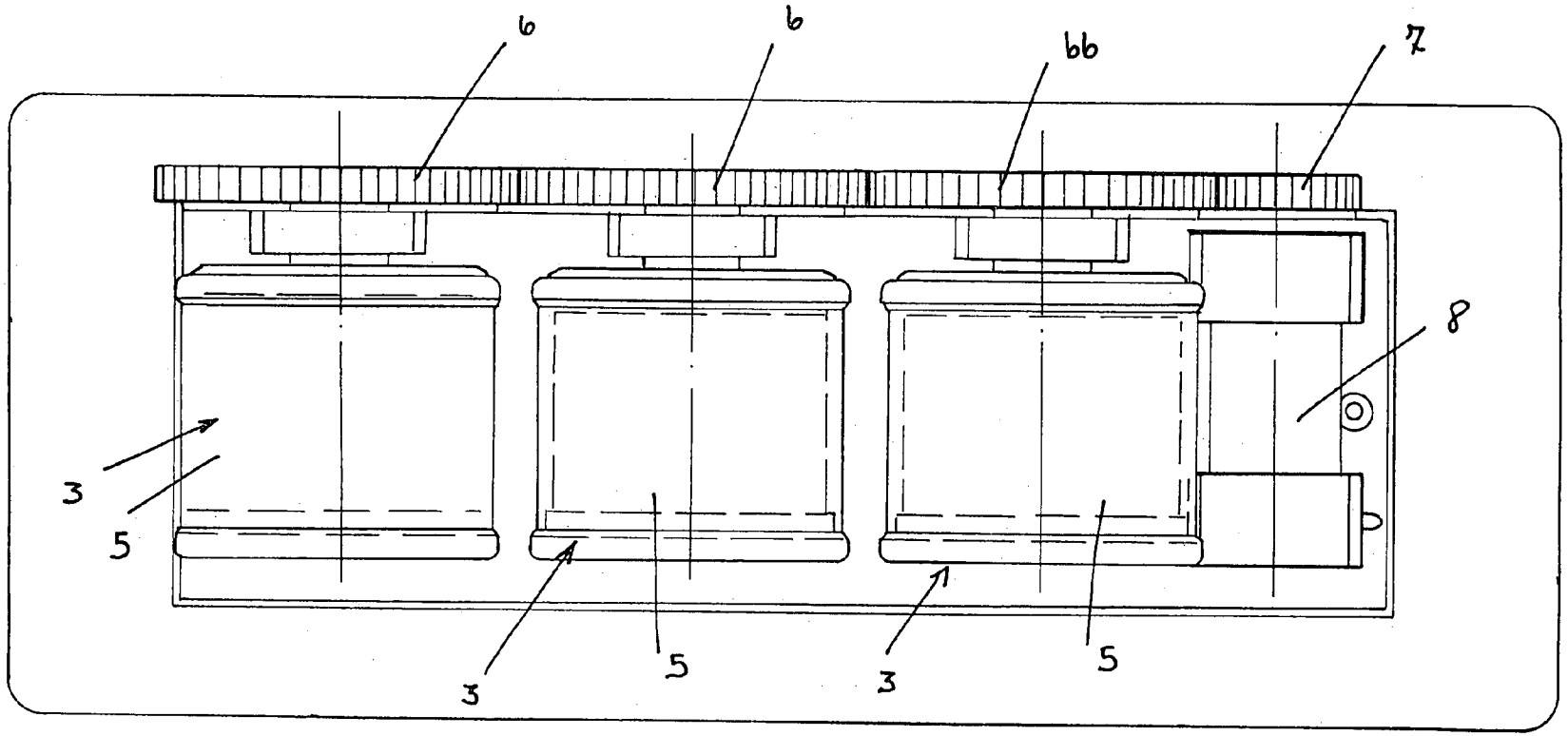
FIG. 2 is a top plan view of the device shown in FIG. 1.
Figure 3:
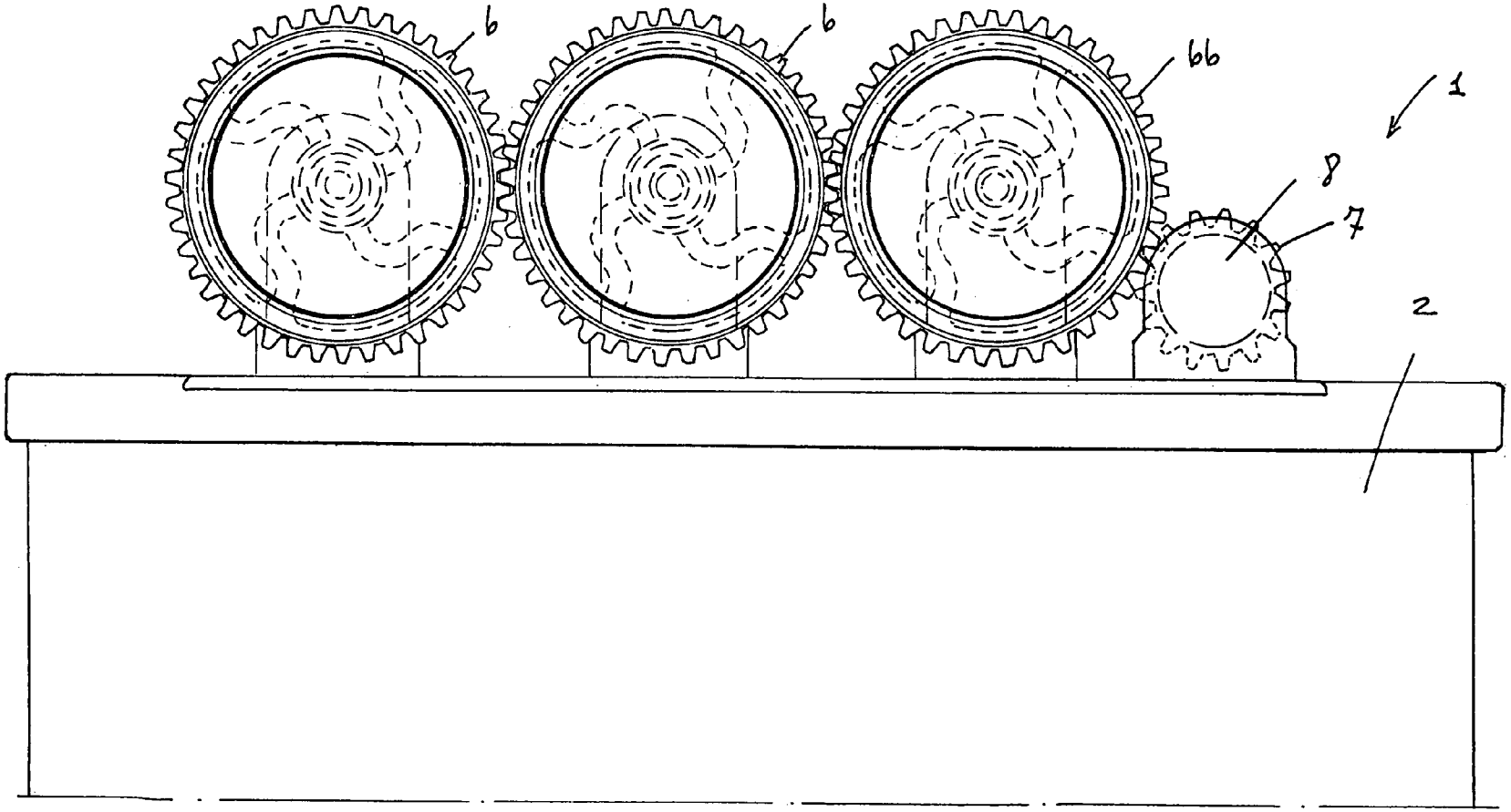
FIG. 3 is a rear elevation view of the device according to the invention.

With reference to the number references of the above mentioned figures, the support device, according to the invention, which has been generally indicated by the reference number 1, comprises a base 2 including a plurality of rotary supporting adjoining mutually engaged elements 3, each of which comprises an exposed drum element 5 and supporting a wrist watch, which is schematically illustrated by dashed lines and being indicated by the reference number 4, through latching means, not specifically shown.

More specifically, said latching means would be coupled to a said respective drum element 5, optionally in a recess or notch formed therein, therewith is moreover made rigid a gear wheel 6.

Each said drum element 5 rigidly supports one end of a gear wheel 6 each of which meshes with a corresponding gear wheel of an adjoining drum element 5 .

At least a said gear wheel, indicated by the reference number 66 in the figures, meshes with a pinion 7 of a motor geared unit 8 coupled to said base 2 to be continuously rotatively driven by said unit 8, thereby continuously driving, owing to their always meshing gear wheels 6, said drum elements 5. The gear wheel 66, as shown, is preferably an end gear wheel of the drum element gear wheel series.

Figure 5:
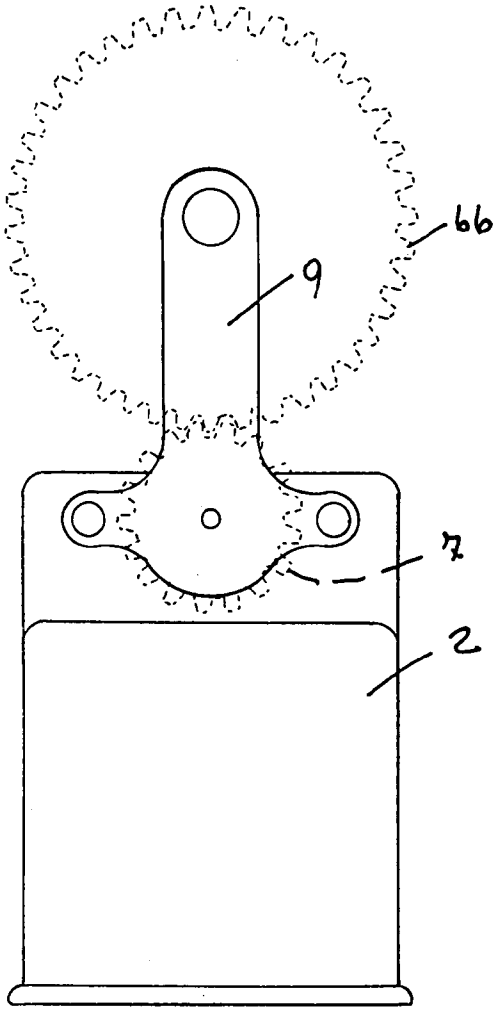
FIG. 5 is a partial front elevation view of the device according to the invention.
Figure 4:
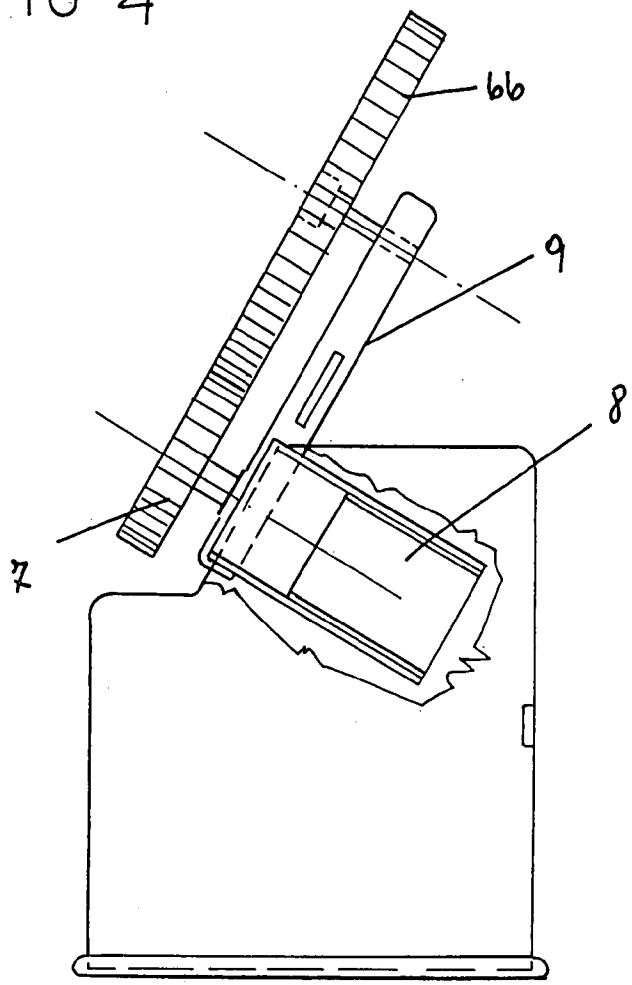
FIG. 4 is a side elevation view of the device according to the invention, showing a rotary inclined axis for the rotary supporting elements.

FIGS. 4 and 5 show a device in which the geared motor unit 8 is substantially embedded in the base 2 and meshes with a gear wheel 66 the rotary axis of which is substantially inclined with respect to the horizontal line.

A bracket 9 is moreover provided for suitably supporting the mentioned gear wheel 66.

Thus, the inclined rotary axis will provide a very good simulation of the wrist motion and a possible improved exhibition to the view of the watch.

It has been found that the inventive device fully achieves the intended aim and objects.

In fact, the invention provides a supporting and winding-up device adapted to hold in an actuated or active condition the automatic wrist watch movements in an efficient manner, from a mere mechanic standpoint, while providing an improved exhibition to the view of the aesthetic aspect of the wrist watch.

In practicing the invention, the used materials, as well as the contingent size and shapes, can be any, depending on requirements.

The invention claimed is:

1. An improved device for supporting, winding-up and preserving automatic wrist watches, wherein said device comprises a base supporting a plurality of adjoining rotary supporting elements, each said supporting element comprising and exposed to view a drum element having an end gear wheel, each gear wheel of each said drum element continuously meshing with either one or two corresponding gear wheels of corresponding one or two of said drum elements, each said drum element including latching means for supporting a respective wrist watch, a gear-motor unit for continuously rotatively driving one of said end gear wheels of one of said drum elements wherein as said gear-motor unit is actuated, all of said drum elements are continuously rotatively driven.

2. A device according to claim 1, wherein said one end gear wheel is the gear wheel of an end said drum element directly engaging with a gear wheel of said gear motor unit.

3. A device according to claim 1, wherein each drum element comprises a rotary axis which is inclined with respect to a horizontal line.

* * * * *